US006732560B1

(12) United States Patent
Winterhalter et al.

(10) Patent No.: US 6,732,560 B1
(45) Date of Patent: May 11, 2004

(54) HYDROFORMING APPARATUS WITH RETRACTABLE PART LOCATORS

(75) Inventors: George Thomas Winterhalter, Berkley, MI (US); Mircea M. Ghiran, Lake Orion, MI (US); Bruce Steven Shimanovski, Southfield, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/440,811

(22) Filed: May 19, 2003

(51) Int. Cl.[7] ..... B21D 26/02; B21D 9/15; B21D 17/02

(52) U.S. Cl. ..... 72/62; 72/61; 29/421.1

(58) Field of Search ..... 72/59, 60, 61, 72/62, 318, 316; 29/421.1

(56) References Cited

U.S. PATENT DOCUMENTS 3,501,934 A * 3/1970 Engel et al. ..... 72/58
4,641,407 A * 2/1987 Blevins et al. ..... 29/237
5,233,856 A * 8/1993 Shimanovski et al. ..... 72/62
5,321,964 A * 6/1994 Shimanovski et al. ..... 72/58
5,481,892 A * 1/1996 Roper et al. ..... 72/61
5,553,474 A * 9/1996 Nokajima et al. ..... 72/60
5,775,153 A * 7/1998 Rigsby et al. ..... 72/58
6,006,567 A * 12/1999 Brown et al. ..... 72/58
6,154,944 A * 12/2000 Mason et al. ..... 72/58
6,510,720 B1 * 1/2003 Newman et al. ..... 72/61
6,637,246 B1 * 10/2003 Shimanovski et al. ..... 72/62

* cited by examiner

*Primary Examiner*—David B. Jones
(74) *Attorney, Agent, or Firm*—Charles E. Leahy

(57) ABSTRACT

Hydroforming apparatus is provided with retractable part locators that are adapted when extended to receive and hold end portions of a tubular part to be hydroformed and thereby support and hold the part between the hydroforming dies when the dies are open. Seal units mounted on separate elevators have a retractable seal carrier and the seal carriers are adapted when the seal units are elevated to advance and initially engage the respective tubular part end portions while the part is being so held. The part locators are adapted to release the end portions of the part and retract out of the way of the seal carriers to permit the seal carriers to then further advance on the respective end potions of the part to a position closely adjacent the end faces of the dies while also centering the part lengthwise with respective to the dies prior to die closure. The seal unit elevators are adapted to lower the seal units with the tubular part to a position aligning the end portions of the part with open ends of the die cavity when the dies close. And the retractable part locators, following the hydroforming of the part and elevation of the part with the seal units by the seal unit elevators, are adapted to again extend and clamp the now hydroformed part to the part locators prior to disengagement of the seal carriers from the part.

11 Claims, 7 Drawing Sheets

HYDROFORMING APPARATUS WITH RETRACTABLE PART LOCATORS

TECHNICAL FIELD

This invention relates to hydroforming apparatus and more particularly to devices for locating a tubular part for engagement by the seal units in the apparatus while also locating the part between the dies of the apparatus.

BACKGROUND OF THE INVENTION

In the apparatus for hydroforming a tubular part, there is typically a lower die and an upper die that are pressed together to form a die cavity that extends about the part. Wherein the cavity has the shape to which the part is required to be formed and extends to opposite end portions of the dies and wherein the part has ends that extend beyond the ends of the dies for engagement by seal units that deliver hydraulic fluid under pressure to the interior of the part and later provide for exhausting this fluid. To reduce cycle time as well as prevent against possible bending or collapse of the part prior, to and/or during die closure, the part can be prefilled with the hydraulic fluid at a relatively low pressure and this requires that the seal units sealingly engagement with the end portions of the part prior to the dies closing on the part. And for such seal unit engagement with the part prior to die closure, it is important that the end portions of the part be accurately aligned with the seal units to effect their sealed engagement. As otherwise, proper sealing may not be obtained and the part and/or the seal units may be damaged.

The seal units may also be used to center the part lengthwise with respect to the dies prior to die closure through their engagement with the ends of the part. In that case, it is important that when the seal units are caused to engage with the ends of the part for such centering operation they do so in an efficient and reliable manner. Moreover, because the end portions of the part project from the dies for engagement with the seal units, there is the possibility that any projecting end portion of the part not captured by the seal units may burst during the hydroforming of the part and result in having to scrap the part.

An example of hydroforming apparatus that does provide for accurate alignment of projecting end portions of a round tubular part with the seal units is disclosed in U.S. Pat. No. 5,321,964 assigned to the assignee of this invention. As disclosed therein, each of the seal units is provided with a locator member and a backup member. The backup members are fixed with respect to the upper die and the locator members and their associated seal unit are mounted on separate elevators that are supported by springs with respect to the lower die. With the seal units retracted, the tubular part is loaded such as by a robot and at what will be its projecting end portions onto the locator members which locate the end portions in alignment with the respective seal units while the seal units and locator members are located and held by their respective elevator at an elevated position with respect to the lower die. The seal units are then extended to sealingly engage the respective end portions of the part while centering the part lengthwise with respect to the dies. The upper die is then lowered onto and pressed against the lower die to form the die cavity about the part. As the upper die is lowered to form the die cavity, this upper die movement also causes capture of the projecting end portions of the part between the respective locator and backup members as the dies are pressed together. This upper die movement also causes lowering of the elevators and the seal units and thereby the part engaged by the seal units whereby an inward region of the end portions of the part are ultimately received in alignment with terminal end portions of the die cavity as the dies are pressed together about the part.

While such apparatus has proven to provide satisfactory alignment of the part with the seal units, it has been found that because the end portions of the part are not fully radially restrained by the locator members of the respective seal units during the engagement of the seal units with the part prior to die closure, the part may bounce or be jostled and as a result interfere with the centering of the part with respect to the dies by the seal units and possibly result in damage to the part and/or the seal units.

One successful way of solving such problems is disclosed in co-pending U.S. patent application Ser. No. 10/278,428 filed Oct. 23, 2002 entitled "TUBULAR PART LOCATOR FOR HYDROFORMING APPARATUS" and assigned to the assignee of this invention. In this apparatus, each seal unit is provided with a tubular part locator comprising a locator member directly associated with the seal unit in a fixed relationship, a backup member rigidly fastened to the upper die and a pair of clamping arms that are pivotally mounted on the locator member and are operated by separate pneumatic cylinders. And the seal units and their associated locator member and clamping arms are all mounted on separated elevators at the opposite ends of the dies.

The locator members have a concave surface and adjoining guide surfaces wherein the concave surface is of limited extent and conforms to the outer surface of the part and has a centerline coincident with that of the seal unit. And the guide surfaces on the respective locator members are adapted to guide the respective end portions of the part onto the concave surface of the locator members and thereby into alignment with the respective seal units.

The clamping arms also have a concave surface conforming to the outer surface of the part but of substantially less extent than the concave surface of the locator member and are adapted on pivotal movement by their pneumatic cylinder to clamping positions to clamp the end portion of the part on the concave surface of the locator member to thereby prevent bouncing or jostling of the part while the seal unit is then brought into sealing engagement with the end portion of the part. The backup member also has a concave surface of limited extent conforming to the outer surface of the part and is adapted to move with the upper die to a backup position as the upper dies closes on the part where its concave surface then helps clamp the end portion of the part on the concave surface of the locator member.

The backup member when in its backup-clamping position is also adapted to hold the clamping arms in their clamping position during hydroforming of the part to thereby relieve the pneumatic cylinders of having to resist the hydroforming force acting in the end portion of the part outward on the pivot arms. And the combined concave surfaces of the locator member, clamping arms and backup member by completely encircling the end portion of the part between the dies and the respective seal unit act to prevent bursting of the end portion of the part during the hydroforming operation.

SUMMARY OF THE INVENTION

While the above described forms of hydroforming apparatus have proven successful, there remains a desire to both simplify and compact the apparatus while maintaining the tubular part locators with accurate locating ability and sufficient clamping ability. Moreover, there remains a desire to shorten the length of the tubular stock required to produce the part in the hydroforming operation to thereby save material and reduce cost.

To these ends and in accordance with the present invention, the seal units that are located at opposite end faces of the dies remain supported on separate elevators that are adapted to locate the seal carriers of the respective seal units in alignment and to elevate the seal units to a first position for initial engagement of the seal carriers with the respective end portions of the tubular part when the dies are open. And the tubular part locators are adapted to locate and firmly hold the end portions of the tubular part for engagement by the seal carriers in a manner similar to previous practice but instead of being mounted in a fixed relationship with the respective seal units are now made retractable with the latter operation being accomplished by also mounting them on separate elevators. Wherein the retractable part locators including their elevators are made very compact with the part locator elevators being provided by compact slide mechanisms that are operated by pneumatic or hydraulically operated actuators and being located to between the respective seal unit elevators and the end faces of the dies.

The part locator elevators are adapted to cooperatively elevate the part locators to positions where they receive and locate and hold the end portions of the tubular part in alignment with the respective seal carriers of the seal units when the seal units are in their aforementioned first position and the dies are open. And also while the seal carriers are caused to then advance and initially be received on the respective end portions of the tubular part. The part locators are adapted to then release the end portions of the tubular part after this initial seal carrier advancement and the part locator elevators are adapted to then lower the part locators to positions out of the way of the respective seal carriers so as to permit the seal carriers to then be further advanced on the respective end portions of the tubular part to points closely adjacent a plane containing the respective end faces of the dies. The seal units are effectively sealingly engaged with ends of the tubular part during the latter and final advancement of their seal carrier and the part can then be prefilled prior to containment of the part in the dies to prevent possible distortion of the part during die closure. The seal unit elevators are adapted to then lower the respective the seal units together with the tubular part to the aforementioned second position where the dies close on the prefilled tubular part.

As a result, the end portions of the tubular part that project from the ends of the dies are fully received in the seal carriers of the seal units for the hydroforming operation that then takes place and are thereby fully contained by the seal units and very effectively prevented from bursting by the high hydroforming pressures that are used. Furthermore, this is accomplished with a very compact hydroforming apparatus arrangement wherein the retractable part locators are made compact as well as their elevators, which are separate from the seal unit elevators that thereby only need to support the seal units. Moreover, the end portions of the part that project from the dies only need to be long enough to provide for sealed engagement with the seal units thereby minimizing the length of tube stock needed in the processing of the hydroformed part.

These and other aspects of the present invention including the entire functional capability of the retractable part locators will become more apparent from the accompanying drawings and following detailed description of exemplary embodiments of the invention.

DESCRIPTION OF EXEMPLARY EMBODIMENTS

Referring to the FIGS. 1–7, there is shown hydroforming apparatus 10 for hydroforming a round tubular part 12 to a required shape such as a motor vehicle structural component wherein for example a tubular steel part having a 6-inch outer diameter is required to be hydroformed into a motor vehicle side rail. And wherein only one end portion of the apparatus and the part is shown and it will be understood that the other end portion of the apparatus and that of the part is like that shown and described herein.

Figure 7:
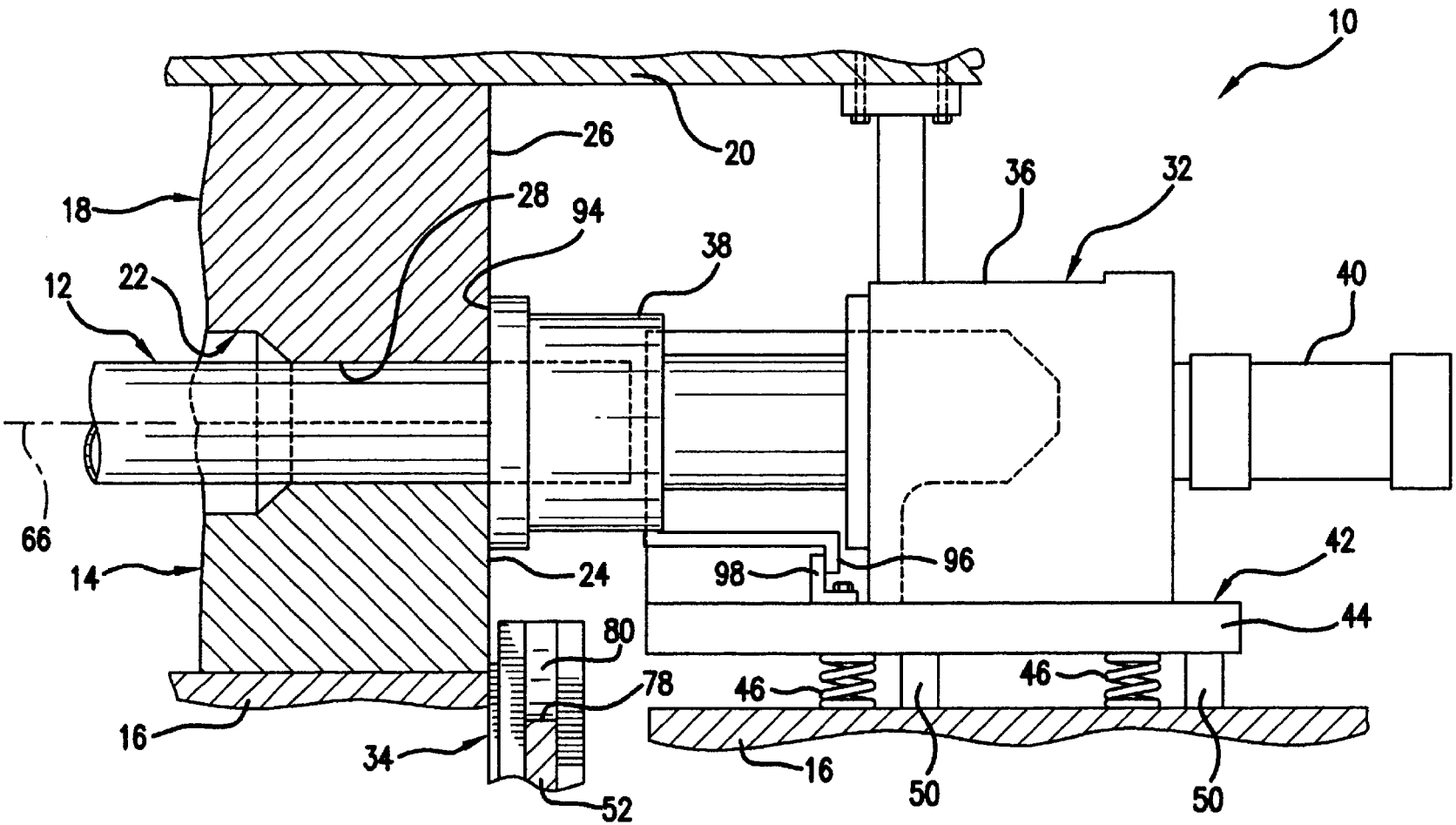
FIG. 7 is a view like FIG. 6 but showing the tubular part lowered with the seal unit and the dies closed on the tubular part.

The apparatus comprises a lower die 14 that is rigidly fastened to the bedplate 16 of a hydroforming press of a conventional type and an upper die 18 that is rigidly fastened to the press plate 20 of the press. In a conventional manner, the upper die 18 when pressed against the lower die 14 cooperates with the lower die to form a closed die cavity 22 about the part as shown in FIG. 7. Wherein the die cavity 22 has the required shape to which the part is to be formed and terminates at opposite end faces 24 and 26 of the respective dies 14 and 18 in aligned cylindrical die cavity end portions 28 (only one such die cavity end portion and the associated die end faces being shown). The die end faces 24 and 26 at the opposite ends of the dies are flat and vertically aligned (lay in the same plane) and the tubular part 12 to be hydroformed has end portions 30 at the opposite ends thereof that are received by the respective end portions 28 of the die cavity 22 and project predetermined and equal distances from the opposite ends of the dies 14 and 18 when the part 12 is centered lengthwise with respect thereto as described in detail later (only one such end portion 30 of the tubular part 12 being shown as mentioned earlier).

A seal unit 32 and a retractable tubular part locator 34 are located adjacent each other at each end of the dies 14 and 18 with the seal unit arranged outboard of the part locator and it will be understood as mentioned earlier that a like seal unit and retractable tubular part locator are located at the opposite end of the dies in a like manner. The purpose of the part locators 34 being to receive and accurately locate and hold the respective end portions 30 of the part being processed in alignment with the respective seal units 32 prior to operative engagement of the latter with the end portions of the part.

The seal unit 32 includes a housing 36 supporting a seal carrier 38 and an actuator 40 wherein the latter is operable to engage the seal carrier with the respective end portion 30 of the part. The seal unit 36 is mounted on an elevator 42 having a floor 44 that is supported by springs 46 on the bedplate 16 and is limited to vertical movement only. The seal unit housing 36 is rigidly fastened to the elevator floor 44 and the elevator is normally held by the springs 46 in an elevated position as shown in FIGS. 1, 2, 4, 5 and 6 and is moved downward against the springs with lowering of the upper die 18 as shown in FIG. 7. Such downward movement being effected by a pusher member 48 that is rigidly fastened to the press plate 20 and pushes down on the seal unit housing 36 as the upper die 18 closes on the lower die 14. And wherein the elevator floor 44 limits such downward movement of the elevator 42 to the position shown in FIG. 7 by bottoming or stopping against stop members 50 that are rigidly fastened to the press bedplate 16.

The stop members 50 act to position the tubular part 12, when the seal unit 32 is engaged therewith, in alignment with the respective cylindrical die cavity end portion 28 when the dies close about the part and the upper die 81 is pressed against the lower die 14 as shown in FIG. 7. The functions of the elevator supported seal unit 32 and the like elevator supported seal unit at the other end of the part being (1) to sealingly engage the ends of the part and also center the part lengthwise between the ends of the dies prior to die closure, (2) to supply a suitable liquid such as a water based solution to the interior of the part to prefill the part at a relatively low pressure prior to die closure, (3) to continue to supply the liquid to the part at a pressure sufficiently high enough to form the part to the die cavity surface following die closure, (4) to exhaust the liquid from the hydroformed part, and (5) to finally retract from engagement with the hydroformed part to permit removal of the hydroformed part after opening of the dies. With all these operations being described in further detail later. The seal unit and seal unit elevator at each end of the dies are like those disclosed in the aforementioned U.S. Pat. No. 5,321,964 that is hereby incorporated by reference and to which reference is made for a more detailed disclosure thereof apart from what is shown and described herein.

The retractable tubular part locator 34 at each end of the dies is located between the respective seal unit 32 and the respective die end faces 24 and 26 and closely adjacent the latter. The retractable tubular part locator 34 is a relatively simple and compact assembly and generally comprises a locator member 52 that is rigidly fastened to an elevator 54 that is operated by an actuator 56, and a clamping arm 58 that is pivotally mounted on the locator member 52 and is operated by an actuator 60. See FIG. 2. Wherein the part locator elevator 54 is limited to vertical movement only and is preferably a slide type of mechanism, and both the part locator elevator actuator 56 and the clamping arm actuator 60 are preferably pneumatic cylinders of a conventional type. And wherein the part locator 34 has a relatively small overall dimension measured lengthwise of the apparatus and thereby contributes in substantial measure to the compactness of the apparatus as will become apparent from the following description of the structural details of the retractable part locator assembly as well as being apparent in the drawings.

Figure 2:
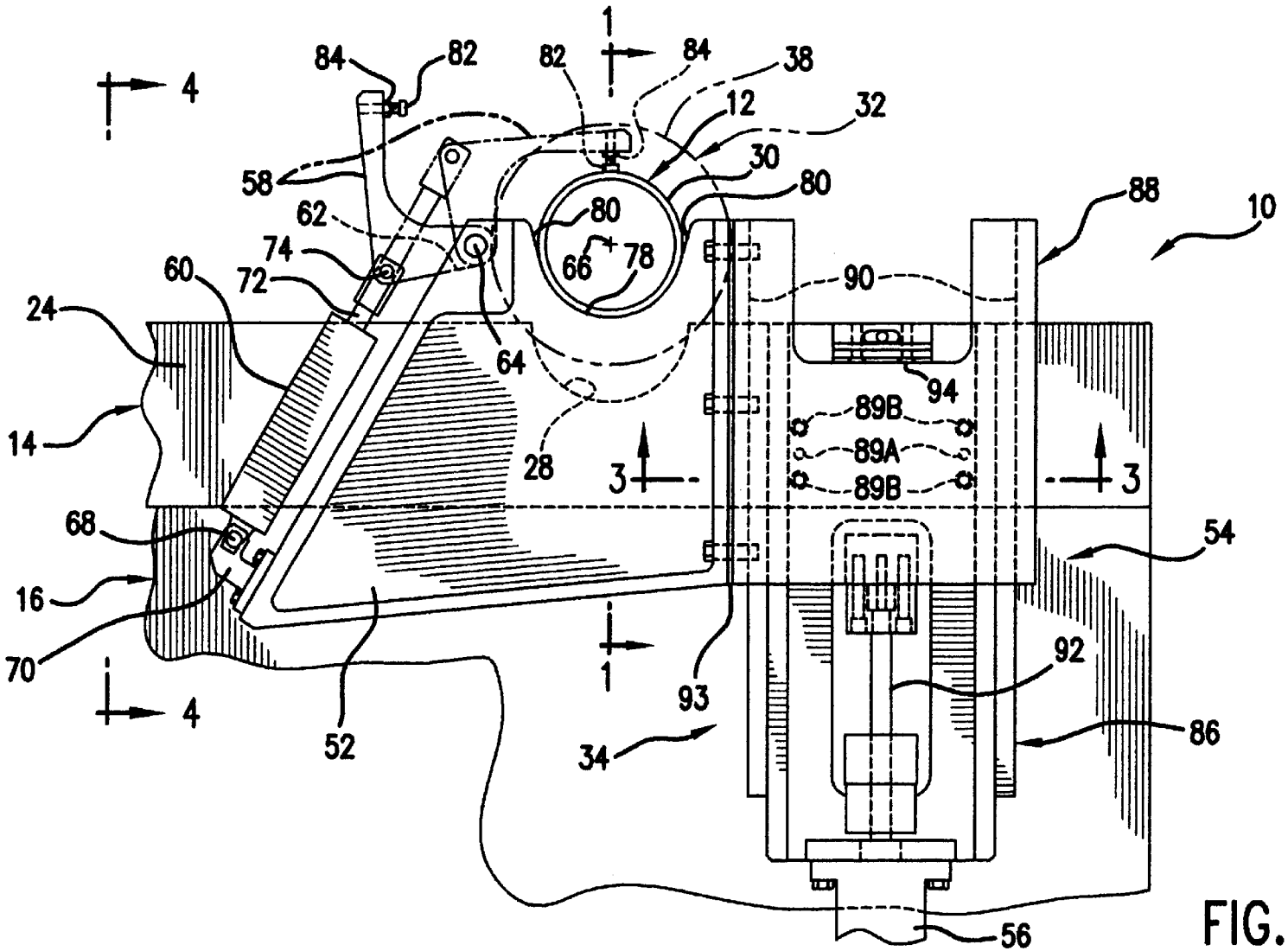
FIG. 2 is a view taken along the line 2—2 in FIG. 1 when looking in the direction of the arrows.
Figure 4:
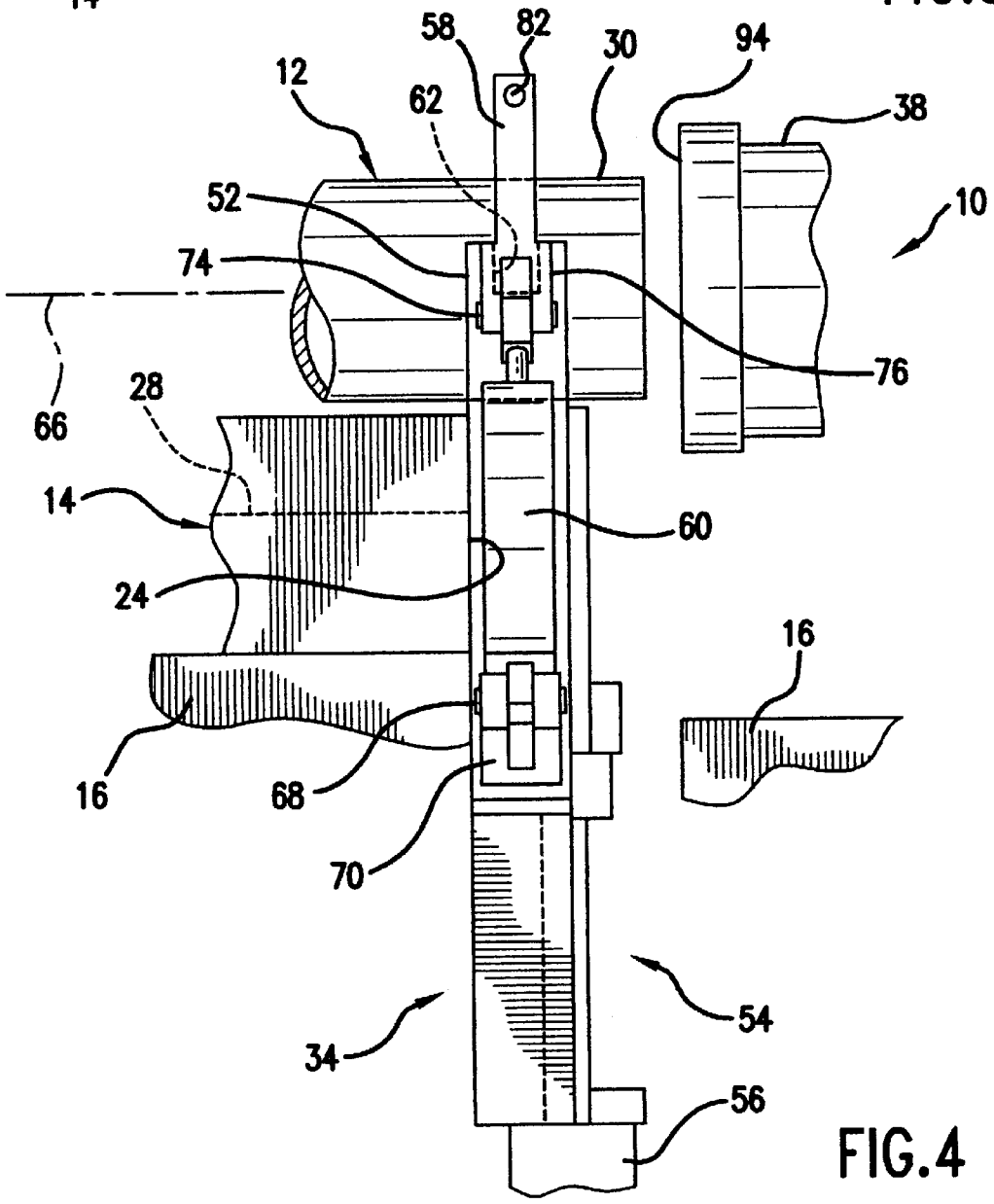
FIG. 4 is a view taken along the line 4—4 in FIG. 2 when looking in the direction of the arrows.

The clamping arm 58 of the part locator 34 has an approximately right-angle configuration as viewed from the side in FIG. 2 and is received at one end in a slot 62 in an upper outboard corner of the locator member 52 as shown in FIGS. 2 and 4. With the clamping arm pivotally connected at this end by a pin 64 to the locator member 52 for pivotal movement about an axis parallel to the centerline 66 of the seal unit 32. See both FIGS. 2 and 4.

The clamping arm actuator (pneumatic cylinder) 60 is operatively connected between the other end of the clamping arm 58 and the locator member 52 so to effect angular or pivotal movement of the clamping arm between its open and closed positions. With the open position being shown in solid lines and the closed position being shown in phantom lines in FIG. 2. The above mentioned operative connection is provided at one end of the actuator 60 by a pivot pin 68 that is received by the lower end of the housing of the actuator 60 and by an eye bracket 70 that is rigidly fastened to the locator member 52 near the lower end of the latter. See FIG. 2. The actuator 60 has a piston rod 72 extending upward from the housing of the actuator and this operative connection is completed at the other end of the actuator 60 by a pivot pin 74 that is received by the upper end of the piston rod 72 and an eye bracket 76 that is formed integral with the clamping arm 58 at the bend in the arm. See FIGS. 2 and 4.

The locator member 52 is adapted to receive an end portion 30 of the part for axial alignment with the seal unit 32 by the provision of an upwardly-facing concave semi-cylindrical surface 78 and adjoining flat edge surfaces 80 that converge in the direction of the concave surface 78 to form a part receiving pocket. See FIG. 2. The concave surface 78 forming the bottom of the pocket conforms to the outer surface of the tubular part 12 and has a centerline that is by elevation of the locator member 52 caused to align with the centerline 66 of the seal unit 32 as described in more detail later. The converging edge surfaces 80 of the part receiving pocket provide guides for receiving and guiding in a funneling manner the end portion 30 of the part downward onto the concave surface 78 of the locator member 52 and thus into alignment with the center line 66 of the seal carrier 38 as also described in more detail later.

The part locator member 52 is located by the part locator slide mechanism 54 close to the end face 24 of the lower die 14 and the clamping arm 58 is located by the locator member 52 at one side of where the die cavity terminates at this end of the lower die as shown in FIG. 2. The clamping arm 58 has a rigid clamping pad 82 threadably fastened thereto and when the upper die 18 is raised sufficiently and the clamping arm is pivoted by its actuator (pneumatic cylinder) 60 to an open or part receiving/part releasing position as shown in solid lines in FIG. 2, the tubular part 12 can be loaded between the dies in a location where the end portion 30 at each end of the part is then free to drop past the open clamping arm 58 and clamping pad 82 and fall in to the part receiving pocket of the respective part locator member 52.

Figure 5:
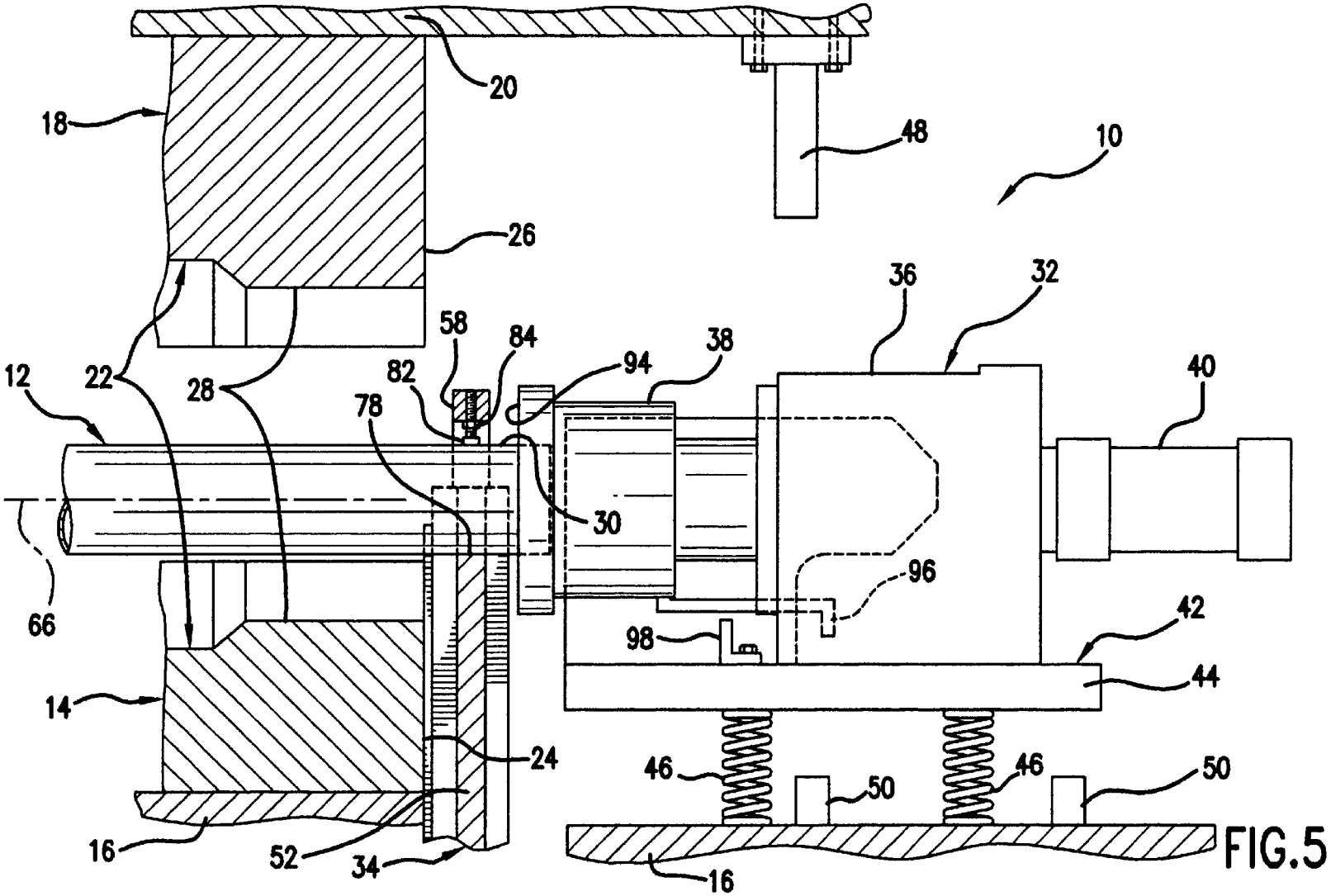
FIG. 5 is a view like FIG. 1 but showing the end portion of the tubular part clamped to the retractable part locator and the seal carrier of the seal unit advanced to initially engage this end portion of the tubular part.

Alternatively, when the clamping arm 58 is pivoted by its actuator 60 to a closed or clamping position as shown in phantom lines in FIG. 2 and in solid lines in FIG. 5, the clamping pad 82 acts to firmly hold the end portion 30 of the part against the semi-cylindrical concave surface 78 of the respective part locator member 52 with a desired amount of clamping force. Such clamping force being just sufficient to hold the part in alignment for seal carrier engagement therewith. With the clamping force adjusted to the desired amount by trial and error when setting up the apparatus by the threaded connection between the clamping pad 82 with the clamping arm 52 wherein when the required adjustment between the pad and arm is obtained, it is then set or fixed with a jam nut 84.

Moreover, the pivot axis of the clamping arm 58 provided by pin 64 is located slightly below the centerline of the concave surface 78 of the locator member 52 and thus below the centerline of the end portion 30 of the part when the end portion 30 is received on the concave surface 78. With such pivot axis location being for the purpose of obtaining a vertically downwardly directed clamping force applied by the clamping arm 58 through the clamping pad 82 to the center of the end portion 30 of the part when the latter is received by the concave surface 78 of the locator member 52.

In further regard to the part locator's elevator (slide mechanism) 54, this mechanism comprises a vertically oriented guide assembly 86 and a slide assembly 88 that is slidably mounted on the guide assembly. The guide assembly 86 is accurately located on the end face 24 of the lower die 14 by dowel pins 89A and is rigidly fastened to the end face by Allen head screws 89B. See FIGS. 1–3. However, it will be understood that the guide assembly 86 could in an alternative mounting manner be rigidly fastened to the bedplate 16 such as by the addition of a suitable mounting bracket to the guide assembly.

Figure 3:
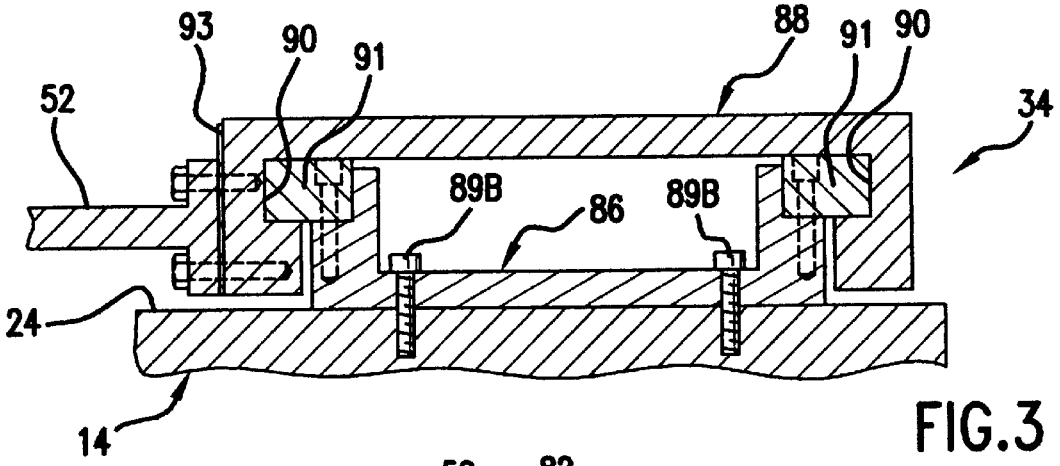
FIG. 3 is a view taken along the line 3—3 in FIG. 2 when looking in the direction of the arrows.

As shown in FIG. 3, the slide assembly 88 has internal vertical side channels 90 at opposite sides thereof that are received by guide bars 91 that are rigidly fastened in the guide assembly 86 and it is the slide assembly 88 that is actuated by the part locator elevator actuator 56 and to which the part locator member 52 is directly fastened for retractable operation thereby. Wherein the part locator elevator actuator (pneumatic cylinder) 56 is rigidly mounted on the lower end of the stationary guide assembly 86 and has a piston rod 92 that is connected to the lower end of the slide assembly 88. See FIG. 2.

The part locator member 52 is rigidly fastened at one side thereof to the slide assembly 88 whereby the part locator 52 by being fastened at its side rather than at its bottom to the slide assembly allows the height of the lower die 14 to be minimized and thereby contributes to minimizing the size and the cost of the hydroforming apparatus. Moreover, a spacer member 93 is sandwiched between the part locator member 52 and the slide assembly 88 with the purpose of the spacer member 93 being to allow fine adjustment between the part locator member 52 and the die cavity 22 by simply varying the thickness of the spacer member in order to obtain the required accurate alignment of the semi-cylindrical surface 78 of the part locator member with respect to the end portion 28 of the die cavity 22.

Figure 1:
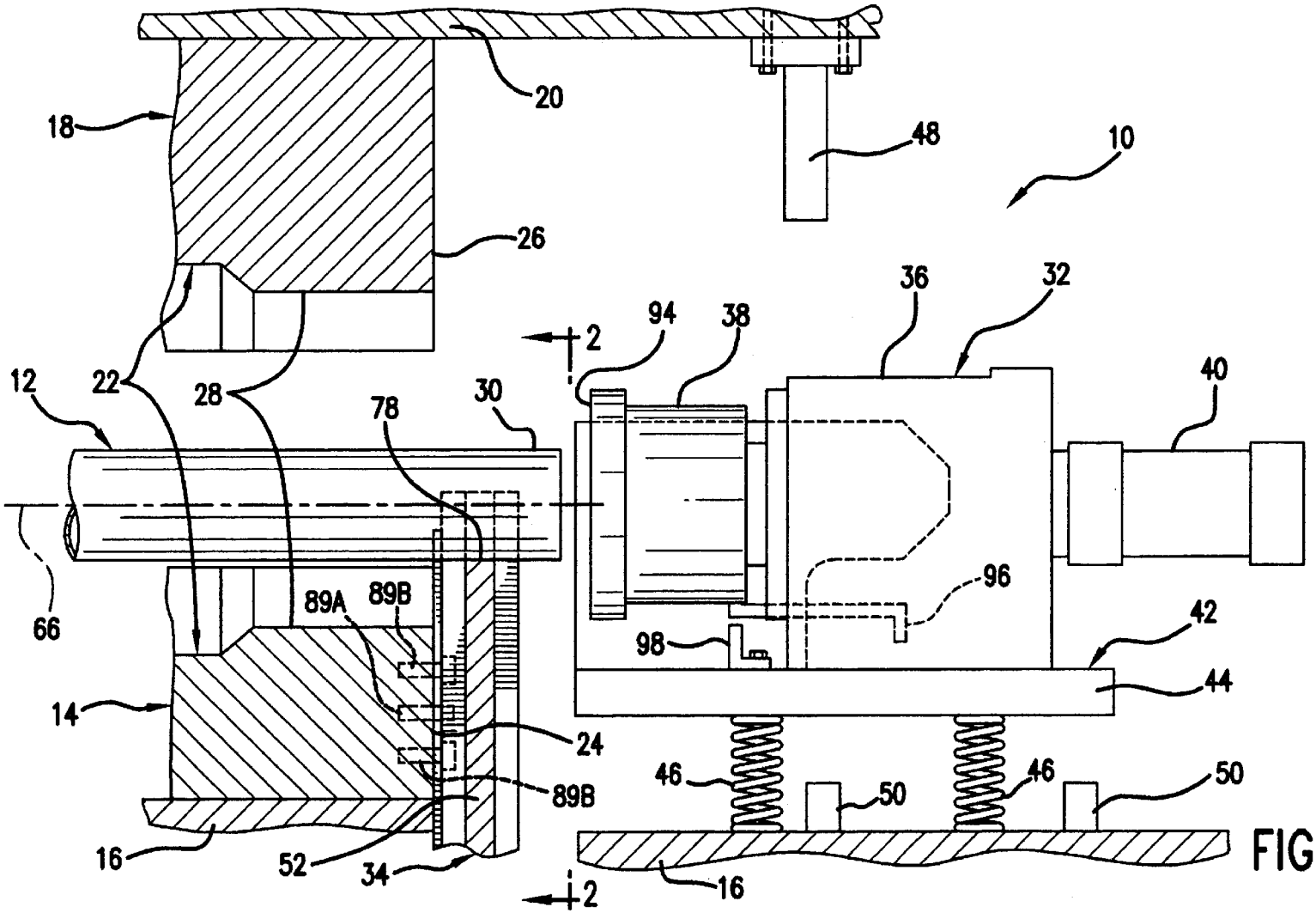
FIG. 1 is a view taken along the line 1—1 in FIG. 2 when looking in the direction of the arrows and shows hydroforming apparatus according to the present invention wherein only one of two like end portions of the apparatus is shown and wherein the hydroforming dies are shown open and the one end portion of the apparatus that is shown includes a retractable part locator that has received one end portion of a tubular part to be hydroformed and a seal unit that is mounted on an elevator and whose seal carrier is so positioned for engagement with the end portion of the part.

With the part locator member 52 so mounted for vertical movement only by the part locator elevator (slide mechanism) 54, it is adapted to be elevated by the part locator actuator (pneumatic cylinder) 56 to the elevated position shown in FIG. 1 where the semi-cylindrical surface 78 of the part locator member 52 is in axial alignment with the seal carrier 38 of the seal unit 32 when the latter is in its normal elevated position. This elevated position of the part locator member 52 being determined by the upper end of the slide assembly 88 engaging a stop member 94 that is a rigid part of the guide assembly 86. See FIG. 2.

In further regard to the details and operation of the seal unit 32 and the operation of the retractable part locator 34 in relation thereto, with the seal unit 32 normally elevated by its elevator 42 by operation of the springs 46 to the position shown in FIG. 1, the seal carrier 38 is initially positioned in a retracted position by the seal carrier's actuator 40 as shown in FIG. 1 to permit loading of the part 12 onto the retractable part locator 34. And thereby loading of the respective end portion 30 of the part into alignment with the elevated seal carrier 38 as accomplished by the guide surfaces 80 and semi- cylindrical surface 78 of the part locator member 52. Following such part loading and alignment, the clamping arm 58 is pivoted by its actuator 60 to its closed position to firmly clamp the end portion 30 of the part with the clamping pad 82 against the semi-cylindrical surface 78 of the locator member 52. See FIG. 5. Following such clamping, the seal carrier 38 is then advanced a limited distance by its actuator 40 in an initial or first stroke from its retracted position in FIG. 1 to the position shown in FIG. 5 where the seal carrier initially engages (is received on) the end portion 30 of the part and the outer end or end face 94 of the seal carrier is located close to the clamping arm 58 while the latter remains in its closed clamping position.

Figure 6:
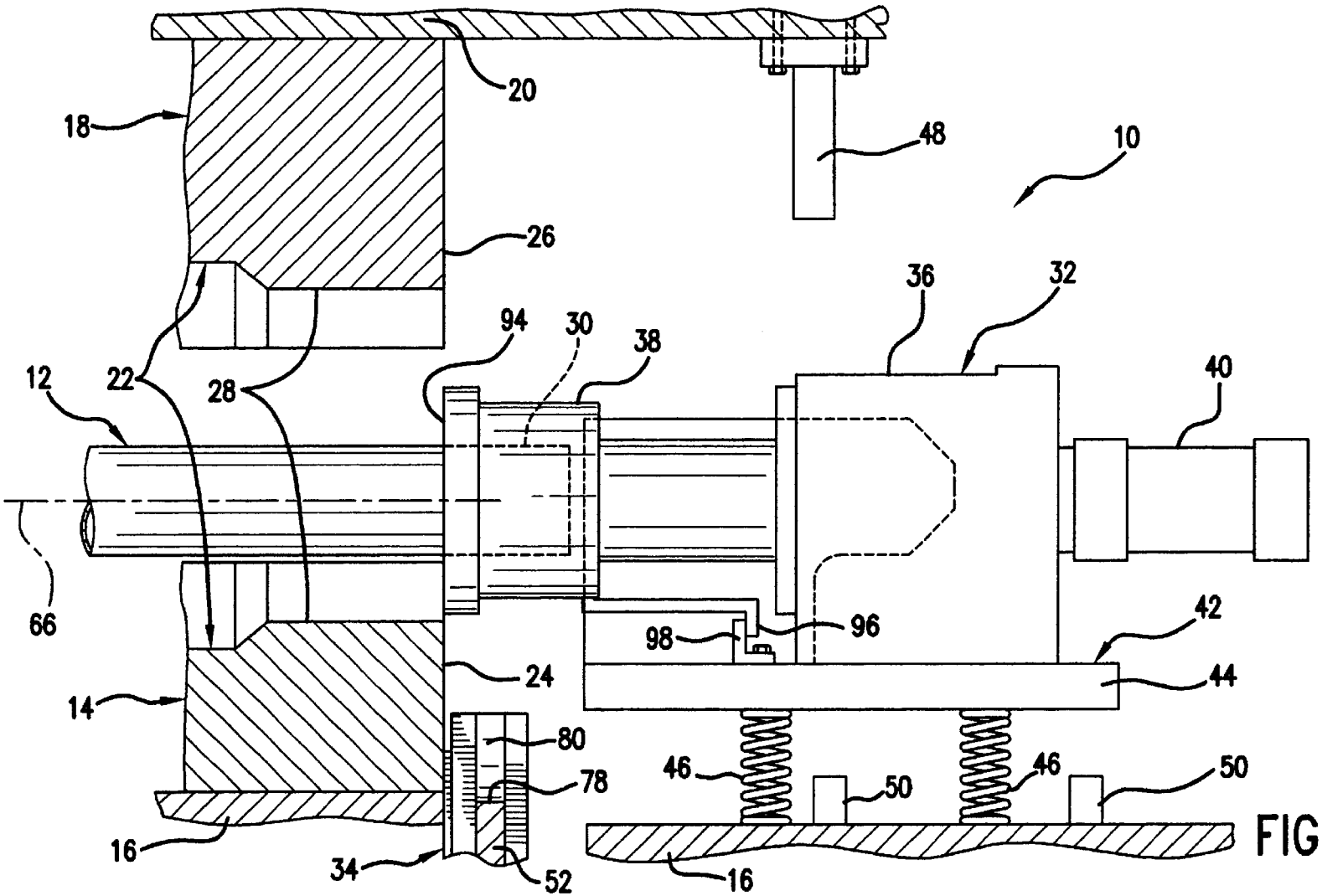
FIG. 6 is a view like FIG. 5 but showing the tubular part released by the retractable part locator, the retractable part locator lowered to a position out of the way of the seal carrier, and the seal carrier further advanced onto the end portion of the tubular part.

Following such limited initial seal unit engagement, the clamping arm 58 is then returned to its open position by its actuator 60 thus releasing the end portion 30 of the part from the part locator 34 which is then lowered by its elevator 54 by operation of its actuator 56 to a position out of the way of the seal carrier 38 as shown in FIG. 6. The seal carrier 38 is then permitted by such part locator retraction to then continue to be advanced on the end portion 30 of the part another limited distance in a second and final stroke by the seal unit actuator 40. Where at full advancement as shown in FIG. 6 the end face 94 of the seal carrier is finally located by the limited final stroke of the seal unit actuator 40 in a position closely adjacent a vertical plane containing the flat end faces 24 and 26 of the dies.

During the latter and final seal carrier advancement, the seal carrier 38 has a stop engaging member 96 that engages a stop member 98 rigidly fastened to the elevator floor 44 and thereby causes a seal in the carrier member to seal against the outer surface of the end portion 30 of the part prior to the seal carrier reaching its most advanced position as described above. And whereby the seal carrier 38 in cooperation with its counter part in the seal unit at the other end of the part, also centers the part lengthwise between the open dies while effecting sealing between the seal units and the part. And whereby the seal carrier of each seal unit is then located immediately adjacent the plane of the associated end faces of the dies but out of their way prior to die closure when the dies close about the end portions of the part.

Then during die closure as the upper die 18 is lowered and pressed onto the lower die 14 and in like operations at the opposite ends of the dies, the pusher members 48 at the opposite ends of the dies engage the housing 36 of the respective seal units 32 causing their elevator 42 to lower and thereby causing the tubular part 12 that is then held by the seal units 32 to lower with the upper die and be seated at its end portions 30 in the die cavity end portions 28 as shown but at only one end of the dies in FIG. 7.

Describing now a typical complete sequence of operations of the retractable tubular part locator 34 as it functions in the hydroforming process and with the understanding that a like tubular part locator and elevator mounted seal unit are provided at a like location at the opposite end of the dies and operate simultaneously in like manner, the upper die 18 and the seal unit 32 and the part locator 34 are all initially held in their raised or elevated position and the seal unit 32 is retracted as shown in FIG. 1 and as described earlier. The clamping arm 58 of the part locator 34 is at that time positioned in its retracted or open position and the part to be hydroformed is then positioned between the dies by suitable means such as a robot of a conventional type that drops the part from above the top of the locator member 52 in order to minimize the cycle time and so that the respective end portion 30 of the part enters between the converging guide surfaces 80 of the locator member. The guide surfaces 80 then guide or funnel the end portion 30 of the part as need be onto the part locating concave surface 78 of the locator member and thus into alignment with the seal carrier 38 of the seal unit 32 as shown in FIGS. 1 and 2. Thus allowing the robot to leave immediately to thereby further minimize the cycle time.

The clamping arm 58 is then immediately pivoted to its closed clamping position as shown in phantom lines in FIG. 2 and in solid lines in FIG. 5 thereby capturing and firmly holding the end portion 30 of the part against the concave surface 78 of the part locator member 52 and thereby in alignment with the then retracted seal carrier 38. The seal carrier 38 is then immediately advanced by the first stroke of the seal carrier actuator 40 as described earlier to initially engage but not yet establish sealing with respect to the end portion 30 of the part. With this operation occurring while the dies remain open and the part 12 remains elevated above the open lower die 14.

The clamping arm 58 of the part locator 34 is then immediately returned to its open position by its actuator 60 thereby releasing the part from the part locator while the seal carrier 38 remains partially engaged with the part. The part locator member 52 is then immediately lowered by its actuator 56 permitting the seal carrier 38 to then be further advanced by the second and final stroke of its actuator 40 to a location closely adjacent the vertical plane containing the flat end faces 24 and 26 of the dies. And wherein the combined weight of the part locator member 52 (including the clamping arm 58 and its actuator 60) and the slide assembly 88 shorten or minimize the time necessary to effect such retraction.

The seal carrier 38 with the second and final stroke of its actuator 40 is then effectively sealingly engaged with the end portion 30 of the part 12 and whereby the part is centered with respect to the end faces at the opposite ends of the dies by like operation of the other like seal unit at the opposite end of the part. The hydroforming liquid is then supplied through one of the engaged seal units 32 at one end of the part to prefill the part prior to die closure. Such prefilling being for the purpose of preventing the part from buckling prior to die closure and crushing during die closure if such highly undesirable circumstances are prone to otherwise result.

The upper die 18 is then lowered causing the pusher member 48 to engage the seal unit housing 36 and thereby lower the seal unit 32 with the engaged prefilled tubular part. With the seal unit elevator 42 eventually stopping against the stop members 50 to align the part and the engaged seal carrier 38 with the die cavity 22 as the dies close about the part 12.

Hydroforming of the part is performed immediately following die closure about the part by continuing to supply the hydroforming liquid to the interior of the part through the one seal unit 32 at the above-mentioned one end of the part. But now at a much higher pressure sufficient to form the wall of the part outward against the die cavity surface. This pressure also acts in the end portion 30 of the part extending past the die cavity 22 and into the immediately adjacent seal carrier 38 and can have the potential to burst the part in this region. But is effectively prevented from doing so by the structure of the seal carrier with its close proximity to the dies and that in effect forms an uninterrupted continuation of the die cavity.

Moreover, because of the close proximity of the seal carrier 38 to the dies 14 and 18 at the end of the seal carrier advancement onto the end portion 30 of the part, the part 12 need only be as long as necessary to accomplish its loading and clamping to the part locator 34 and the subsequent sealing engagement of the seal carrier 38 with the end portion 30 of the part following the release of the end portion 30 from the clamping arm 58 and the retraction or lowering of the part locator member 52 to its out of the way location with respect to the seal carrier. As a result there is also a considerable cost savings as compared with the case where the part locator is not retractable and the part would thus have to have a substantially longer length to allow for the imposition of such a non-retractable part locator between the dies 14 and 18 and the seal carrier 38.

Following the hydroforming operation, the hydroforming liquid is exhausted from the part through the other one of the seal units 32 at the other end of the part, the upper die 18 is raised to its open position returning the pusher member 48 to its retracted position and thereby allowing the seal unit elevator 42 by operation of the springs 46 to return the seal unit but now with the hydroformed part to its initial elevated starting position. The seal carrier 38 is then partially retracted by its actuator 40 to its initial engaging position shown in FIG. 5 and the part locator 34 is then elevated (returned) to its initial elevated position by its elevator actuator 56 and the clamping arm 58 is operated by its actuator 40 to again clamp the end portion 30 of the now hydroformed part to the part locator member 52. The seal unit carrier 38 is then fully retracted by its actuator 56 from the formed part and thus without moving or disturbing the part because of it being clamped to the part locator. And the clamping arm 58 is only then retracted from its closed clamping position to its open position by its actuator 60 thereby leaving the hydroformed part then free to be removed from the hydroforming apparatus such as by the aforementioned robot. Following removal of the finished part, the hydroforming apparatus is then ready for the commencement of another complete cycle.

It will also be understood that the finished part may be removed by another robot to thereby speed up the loading and unloading of the part and reduce the total hydroforming processing time. It will also be appreciated that the part locator assembly as arranged and described above is quite compact in that it has both a relatively short width and length for the various operations that it performs. Furthermore, while the tubular part being hydroformed has been described as having a round cross-section, it will also be understood that depending on the shape of the die cavity required to form the required hydroformed shape, the tubular part being processed may have other cross-sectional shapes such as oval, square and rectangular and that the part locators and seal units are adapted accordingly in accordance with the teachings of this invention.

Moreover, it will be appreciated that a substantial reduction in cycle time is accomplished by not requiring a robot or other type of loader to hold the tubular part until the seal units engage therewith and then having to leave from an interference position between the dies and the seal units that prevents die closure until after the required seal unit engagement is effected. The retractable part locators of the present invention instead holding the tubular part without requiring additional cycle time by permitting removal of the robot from any interfering position immediately following its dropping of the tubular part on the part locators.

It will also be understood that while actuators in the form of pneumatic cylinders have been described for operating the clamping arm and the elevator of the retractable tubular part locators, other type actuators of a suitable type such as a hydraulic cylinder could be used for either and/or both. And it will also be understood that when a greater clamping force is required for a particular part, the part locators may be provided with two like clamping arms each with a clamping pad wherein the clamping arms of each part locator are located at opposite sides of the respective part receiving pocket and are operated simultaneously by separate like actuators and wherein the clamping arms and the adjustable clamping pads are suitably adapted so that the latter engage the part at circumferentially spaced locations. And if even greater clamping force is required for a particular part, it will be further understood that where either one clamping arm or two such arms are employed as described above, they may in lieu of clamping pads be formed with extensive concave cylindrical surfaces for engaging the part as disclosed in the aforementioned co-pending U.S. patent application Ser. No. 10/278,428 filed Oct. 23, 2002 entitled "TUBULAR PART LOCATOR FOR HYDROFORMING APPARATUS" and which is hereby incorporated by reference.

Figure 8:
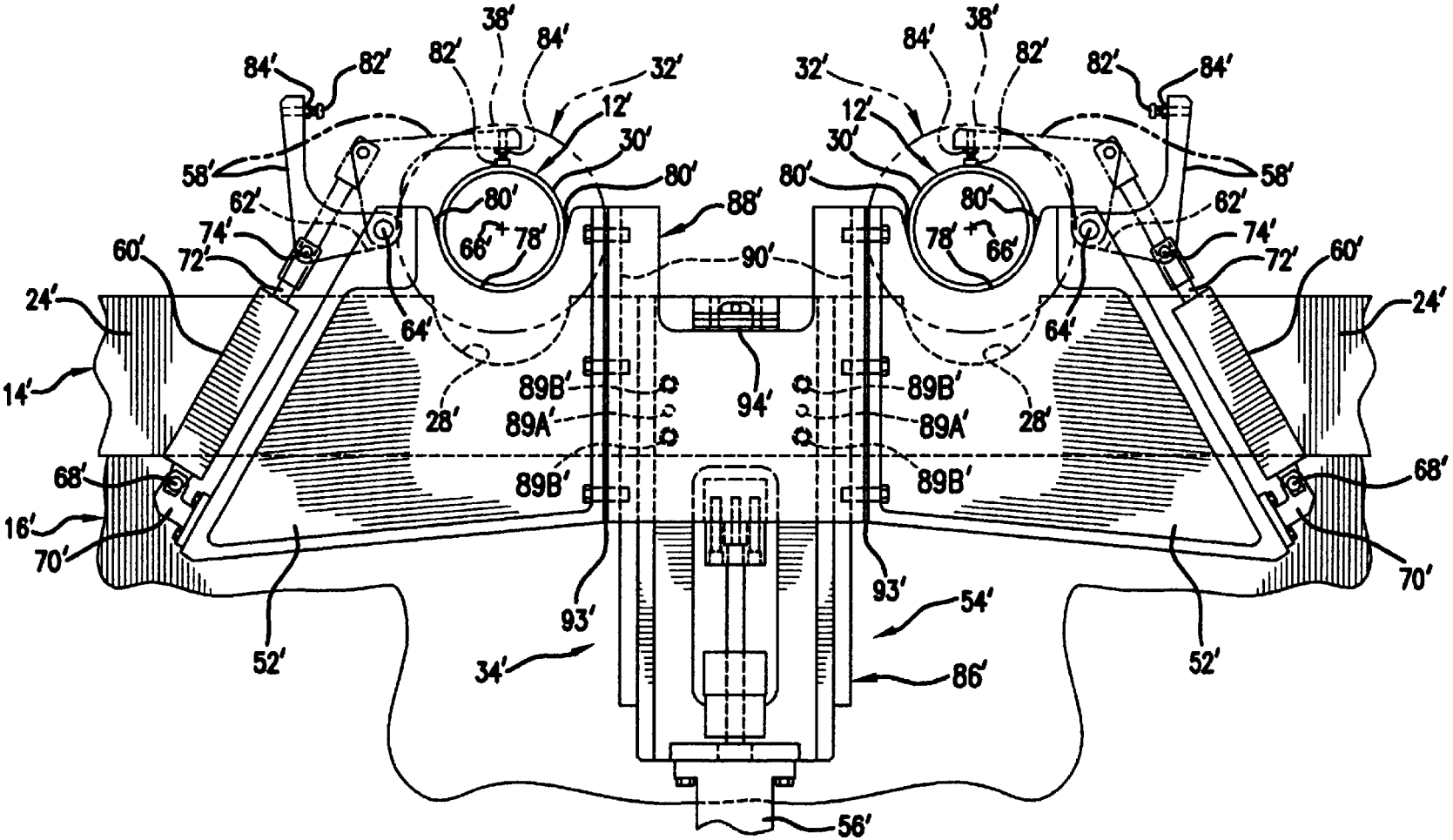
FIG. 8 is a view like FIG. 2 but of another embodiment of the hydroforming apparatus according to the present invention wherein the dies form two cavities for hydroforming two tubular parts simultaneously and there are provided in each end portion of the apparatus twin seal units that are mounted on a singular elevator and a multipart retractable part locator for simultaneously processing the two parts through the hydroforming process.

Moreover, the retractable part locators according to the present invention are also readily adaptable in a very simple and compact manner to serving hydroforming dies having multiple die cavities for hydroforming multiple parts at a time as shown in FIG. 8. Wherein FIG. 8 is a view like FIG. 2 and wherein parts like or similar or corresponding to those in FIGS. 1–7 are identified by the same reference numbers but primed. And wherein it will be understood that the hydroforming dies in the FIG. 8 embodiment now form two parallel cavities when closed that are each like the die cavity 22 in the FIGS. 1–7 embodiment. With only the lower die 14' and the respective end portions 28' of the two die cavities being shown in FIG. 8.

Describing further the FIG. 8 embodiment, the apparatus for the purpose of simultaneously hydroforming two parts now has twin seal units 32' and a multipart (two part) retractable part locator 34' located at each end of the dies. Wherein each multipart part locator 34' has two locator members 52' like in the FIGS. 1–7 embodiment that are mounted on the same elevator 54'. And wherein the twin seal units 32' at each end of the dies and each with their own seal carrier 38' are like that in the FIGS. 1–7 embodiment and are mounted in side-by-side, parallel relationship on separate elevators like in the FIGS. 1–7 embodiment and are raised and lowered simultaneously in like manner as previously described and also operate simultaneously in like manner as previously described but now in respect to the respective parts 12'.

Each part locator elevator 54' comprises a guide assembly 86' and a slide assembly 88' like in the FIGS. 1–7 embodiment. And the respective locator members 52' are rigidly fastened to opposite sides of the slide assembly 88' so as to be located in the required orientation with respect to the two separate die cavities like in the manner described previously with respect to a single die cavity.

Each of the part locator members 52' has a semi-cylindrical concave surface 78', funneling guides surfaces 80', a clamping arm 58' with an adjustable clamping pad 82' and a clamping arm actuator 60' that are associated like before but with respect to the respective die cavities in this embodiment. Wherein the respective clamping arms 58' together with their separate actuators 60' are located in opposite orientation with respect to each other on the outboard sides of the apparatus as seen in this view and wherein the clamping arms 58' by such arrangement pivot in opposite directions to open and close.

The slide mechanism 54' at each end of dies and comprising guide assembly 86' and slide assembly 88' serves both of the locator members 52' at the respective ends of the dies and for that purpose is strategically located centrally between the end portions 28' of the respective die cavities where they terminate at the respective end face 24' of the lower die 14'. As a result, the locator members 52' can be rigidly fastened at their inboard sides to the singular slide assembly 88' as shown and with their clamping arm 58' and clamping arm actuator 60' remaining outboard of the apparatus for ease in assembly and servicing like in the FIGS. 1–7 embodiment.

The twin seal units 32' and the multipart part locator 34' at each end of the dies operate with respect to the respective end portions 30' of the two parts 12' in the same manner as the single seal unit 32 and single-part retractable part locator 34 at each end of the dies operate with respect to the respective end portions 30 of the singular part 12 in the FIGS. 1–7 embodiment previously described. As a result, the hydroforming apparatus in FIG. 8 can process two parts in the same time it takes to process a single part with the hydroforming apparatus in FIGS. 1–7. Moreover, because the part locator members 52' at each end of the dies share the same elevator 54', there is considerable savings in space and cost as compared with employing separate elevators for each.

In addition, the use of spacers 93' between the respective locator members 52' and the slide assembly 88' provides for fine separate adjustment of the part locators 52' with respect to the die cavity with which they are associated. Wherein such fine adjustment is made by simply determining the exact spacer thickness necessary to establish the required location for each separate locator members 52'. Moreover, the spacers 93' allow using the same setup wherein the spacers can have a different thickness so as to accommodate different center-to-center distances between the die cavities. This being particularly advantageous where the die cavities are for forming different shaped parts. For example, the die cavities in the embodiments shown are for forming parts of identical shape and size but the die cavities could also have different shapes for forming two different shaped parts at the same time.

Having described the above exemplary embodiments in a manner to clearly and precisely disclose and teach the present invention, various other forms thereof and modifications thereto will quite likely occur as a result of this disclosure and teaching. And therefore, it will be understood that the present invention is to be limited only by the scope of the appended claims.

What is claimed is:

1. Hydroforming apparatus comprising a pair of dies adapted when open to receive a tubular part to be hydroformed and adapted when closed to form a die cavity about the tubular part wherein end portions of the tubular part extend past opposite ends of said dies, seal units located at said ends of said dies, elevators adapted to elevate and lower said seal units, said seal units having retractable seal carriers adapted to be received over the respective tubular end portions, retractable part locators located at said ends of said dies between said seal units and said die ends and adapted to extend and then receive and hold the respective tubular part end portions and thereby support and hold the tubular part between said dies with the tubular part end portions in alignment with the respective seal carriers when said dies are open and while said seal units are elevated, said seal carriers adapted to advance and initially engage the respective tubular part end portions while the tubular part is being held by said retractable part locators and said seal units are elevated, said retractable part locators adapted to release the respective tubular part end portions and retract out of the way of the respective seal carriers to permit said seal carriers to then fully advance on the respective tubular end potions to positions adjacent the respective ends of said dies, and said seal units adapted when lowered and while said seal carriers remain fully advanced on the respective tubular end portion to locate the tubular part in a position aligning the tubular part end portions with said die cavity as said dies close.

2. Hydroforming apparatus as defined in claim 1 wherein said retractable part locators include at least one pivotal clamping member adapted on pivotal movement to effect clamping of the respective tubular part end portion to the respective retractable part locator.

3. Hydroforming apparatus as defined in claim 1 wherein said retractable part locators are advanced and retracted by separate fluid pressure operated slide mechanisms.

4. Hydroforming apparatus as defined in claim 1 wherein said dies are adapted to form another die cavity for receiving another tubular part, additional seal units like said first-mentioned seal units adapted to be elevated and lowered by the respective said elevators and operate simultaneously with and in like manner as said first-mentioned seal units and with respect to said other tubular part, and said retractable part locators adapted to simultaneously operate with respect to said other tubular part in like manner as with respect to said first-mentioned tubular part.

5. Hydroforming apparatus as defined in claim 1 wherein said retractable part locators have a retractable part locator member with a concave surface and adjoining guide surfaces wherein said guide surfaces are adapted to funnel the respective tubular part end portion onto said concave surface and thereby into alignment with the respective seal carrier.

6. Hydroforming apparatus as defined in claim 4 wherein said retractable part locators have a singular slide mechanism adapted to effect the extension and retraction operations.

7. Hydroforming apparatus as defined in claim 5 wherein said retractable part locators include a clamping arm pivotally connected to said part locator member and adapted on pivotal movement to clamp the respective tubular part end portion to the respective concave surface.

8. Hydroforming apparatus as defined in claim 7 wherein said retractable part locators include a clamping pad adjustably connected to said clamping arm and adapted to directly engage the respective tubular part end portion to the respective concave surface with an adjustable clamping force.

9. Hydroforming apparatus as defined in claim 5 wherein said retractable part locator members have a bottom and a side extending upwardly from said bottom, and said part locator members are rigidly fastened to the respective slide mechanisms at the sides of the respective part locator members.

10. Hydroforming apparatus as defined in claim 6 wherein said part locators have actuator operated clamping arms located at outboard sides of said apparatus adapted to clamp the respective end portions of the respective tubular parts to the retractable part locators.

11. Hydroforming apparatus as defined in claim 1 wherein said elevators following hydroforming of the tubular part and opening of the dies are adapted to elevate said seal units with the tubular part while said seal carriers remain fully advanced on the respective tubular part end portions, and said retractable part locators are adapted to extend and again hold the tubular part end portions while said seal carriers are retracted from the tubular part end portions.

* * * * *